US006938362B2

(12) United States Patent
Saillet et al.

(10) Patent No.: US 6,938,362 B2
(45) Date of Patent: Sep. 6, 2005

(54) REINFORCEMENT FOR A BOOT, IN PARTICULAR A SPORTS BOOT, MORE SPECIFICALLY A CROSS-COUNTRY SKI BOOT, AND A BOOT HAVING SUCH A REINFORCEMENT

(75) Inventors: Benoît Saillet, Albens (FR); Philippe Renard, Moucy (FR); François Girard, Veyrier du Lac (FR)

(73) Assignee: Salomon S.A., Metz-Tessy (FR)

( * ) Notice: Subject to any disclaimer, the term of this patent is extended or adjusted under 35 U.S.C. 154(b) by 303 days.

(21) Appl. No.: 10/117,191

(22) Filed: Apr. 8, 2002

(65) Prior Publication Data

US 2002/0178615 A1 Dec. 5, 2002

(30) Foreign Application Priority Data

Apr. 9, 2001 (FR) ..... 01 04799

(51) Int. Cl.[7] ..... A43B 5/04
(52) U.S. Cl. ..... 36/117.3; 36/117.2; 36/102
(58) Field of Search ..... 36/85, 102, 107, 36/117.2, 117.3

(56) References Cited

U.S. PATENT DOCUMENTS

| | | | | | |
|---|---|---|---|---|---|
| 2,367,808 | A | * | 1/1945 | Starner | 36/30 R |
| 2,379,139 | A | * | 6/1945 | Flink | 36/19.5 |
| 2,401,088 | A | * | 5/1946 | Lumbard | 36/30 A |
| 4,779,361 | A | * | 10/1988 | Kinsaul | 36/102 |
| 5,052,130 | A | * | 10/1991 | Barry et al. | 36/107 |
| 5,123,180 | A | * | 6/1992 | Nannig et al. | 36/43 |
| 5,406,723 | A | | 4/1995 | Okajima | 36/131 |
| 5,918,338 | A | * | 7/1999 | Wong | 12/146 S |
| 5,974,696 | A | * | 11/1999 | Aird et al. | 36/31 |
| 6,101,743 | A | * | 8/2000 | Brown | 36/102 |
| 6,219,940 | B1 | * | 4/2001 | Kita | 36/30 R |
| 6,389,713 | B1 | * | 5/2002 | Kita | 36/30 R |
| 6,497,058 | B2 | * | 12/2002 | Dietrich et al. | 36/69 |
| 2002/0064640 | A1 | * | 5/2002 | Renard et al. | 425/297.4 |

FOREIGN PATENT DOCUMENTS

| | | |
|---|---|---|
| DE | 4229039 | 4/1993 |
| EP | 0029206 | 5/1981 |
| EP | 0595732 | 5/1994 |
| EP | 0931470 | 7/1999 |
| FR | 2600868 | 1/1988 |
| FR | 2682011 | 4/1993 |

* cited by examiner

*Primary Examiner*—Ted Kavanaugh
(74) *Attorney, Agent, or Firm*—Greenblum & Bernstein, P.L.C.

(57) ABSTRACT

A reinforcement for a boot, in particular a sports boot, more particularly a cross-country ski boot. The boot reinforcement makes it possible to improve the torsional stiffness, efficiency, durability, lightness, cost, foot protection, and industrial workability. To achieve this goal, the boot reinforcement according to the invention includes a front zone A from the front end up to the beginning of the plantar arch, a median zone B corresponding to the plantar arch, a rear zone C. The reinforcement includes, at least in the zones B and C, at least one "sandwich" structure constituted by at least one core inserted between at least two layers, and, in the zone A, it is flexible in a substantially longitudinal direction and torsionally stiff. The layers of the sandwich structure are made of composite, carbon fibers/polymeric resin, whereas the core of this sandwich structure is made of synthetic foam, wood or honeycomb. Each zone A, B, C has a longitudinal flexural strength RfA, RfB, RfC, such that RfA<RfB≦RfC. The invention also relates to a sports boot including such a reinforcement.

24 Claims, 5 Drawing Sheets

C
B
A
$L_B$
$L_A$
T
P
β
δ
71°
α
9
11
14
15
16

C
B
A
$L_B$
$L_A$
β
9
11
14
15'
16'

REINFORCEMENT FOR A BOOT, IN PARTICULAR A SPORTS BOOT, MORE SPECIFICALLY A CROSS-COUNTRY SKI BOOT, AND A BOOT HAVING SUCH A REINFORCEMENT

CROSS-REFERENCE TO RELATED APPLICATION

This application is based upon French Patent Application No. 01 04799, filed Apr. 9, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to the field of boots, in particular sports boots, and more particularly sports boots adapted to cooperate with a sports apparatus, such as a cross-country ski, an in-line roller skate, a snow shoe, etc., along a movement in which, the tip of the boot being affixed to the apparatus, the heel can be displaced between a position supported on the apparatus and a position raised in relation to the apparatus.

2. Description of Background and Relevant Information

The aforementioned foot movement is that which is found in particular in cross-country skiing involving the evolutional techniques referred to as the "alternate step" or "skating step." These evolutional modes also exist for sports apparatuses such as roller skis, or roller skates.

The essential qualities desired for the boots adapted to this type of movement are rigidity in the transverse direction (high torsional stiffness), combined with a longitudinal flexibility, especially in the metatarsophalangeal zone (low longitudinal stiffness).

SUMMARY OF THE INVENTION

The present invention thus relates more specifically to a reinforcement intended to improve the aforementioned mechanical properties.

Such a reinforcement is advantageously adapted to be a constituent element of the lower portion of the boot, in particular a sports boot, for example a cross-country ski boot. By way of example, such a lower portion conventionally includes an outer sole adapted to cooperate with the sports apparatus, a lasting insole, and an inner sole. This lower portion is assembled with the upper portion of the boot which includes a vamp, and possibly an upper. The lower edge of the vamp is generally sewn and/or cemented and/or welded to the outer sole, as well as to the lasting sole. There are other lasting methods, especially using the so-called "strobel" technique.

It is indeed important that the boots, in particular sports boots, and more particularly cross-country ski boots, be torsionally rigid or stiff in relation to the longitudinal axis of the boot. This guarantees a good stability of the boot, especially in cross-country skiing, where the boot cooperates with the ski, this torsional stiffness making it possible to ensure that the ski is optimally guided by the boot. Generally speaking, the torsional stiffness of a boot makes it possible to guarantee that the sports apparatus to which it is attached is properly guided.

Furthermore, flexibility of the boot sole in the longitudinal direction is desired for walking and running, and it proves indispensable in the case of a sports boot cooperating with an apparatus, such as a cross-country ski, for example, to which it is fixed only by its front end, especially when moving with the "alternate step". The foot and the boot must be capable of rolling and unrolling easily and in harmony relative to the fixed front tip of the boot.

The boot and the upper and lower portions (bottom assembly) of the boot are subject to bending during almost the entire sporting activity. In practice and in the context of the present disclosure, bending is referred to as that which occurs in the movement in the area of the metatarsophalangeal joint. In its design, the boot must fully respect the positioning of this joint which forms an angle of about 71/72° with the inner tangent to the foot, and which is located along this same tangent at about 73/74% of the total length of the foot.

To promote bending, reinforcements incorporated into the upper portion (upper/vamp) or in the lower portion (bottom assembly of the boot) are conventionally used.

In addition to the mechanical characteristics of torsional stiffness and longitudinal bending flexibility along the metatarsophalangeal axis, other parameters must be taken into consideration, including lightness, cost, industrial workability, etc.

With respect to the bottom assembly reinforcements, which are those aimed at more specifically in the present invention, there are numerous prior technical propositions which, to date, have not been entirely satisfactory.

U.S. Pat. No. 5,406,723 relates to a cycling shoe sole provided with a multilayered structure. The latter is supposed to provide the cycling shoe with sufficient longitudinal rigidity so that it can withstand the bending force which is exerted on the shoe sole during pedaling, while meeting a particularly important lightness requirement to alleviate the exhaustion of the cyclist. The multilayered structure of the shoe sole is constituted by a core made of polyurethane foam inserted between two sheets each constituted of a plurality of composite layers based on glass or carbon fibers embedded in a cross-linked polymer resin (phenol resin). It is clear that such a sandwich reinforcement of a cycling shoe outsole has a torsional stiffness such that it virtually prevents any longitudinal bending movement. In fact, this is precisely what is desired. Consequently, such a reinforcement is really unsuited for boots adapted to enable a rolling/unrolling movement of the boot.

The document EP 0 931 470 describes a sports footwear including a stiffening element incorporated into the lower part (sole unit of the footwear). This stiffening element is an insole or outsole, or a sandwich-type support including a layer 15 made of expanded plastic foam (light wood, vertical plastic cylinders, or a cellular material), this layer being inserted between two layers 13 and 14 based on polymer (nylon, polyurethane, polypropylene), resin or a composite material including synthetic resins in which carbon, aramid, or glass fibers are included. The rigidity of the layers 13 and 14 is higher than that of the layer 15. The thickness of the latter is greater than that of the layers 13 and 14. It appears from FIG. 5 and the specification, column 3, lines 41–53, of the document EP 0 931 470 that the stiffening element can include portions of variable cross-section and different flexibilities, having a greater longitudinal flexibility at the forefoot, in particular. However, such a sole construction remains essentially rigid and is not suited for sports requiring an unrolling movement of the foot as do cross-country skiing, racing, etc. In fact, the document EP 0 931 470 essentially aims at an application to boots having a rigid sole, such as cycling shoes, mountain boots, etc.

French Patent No. 2 600 868 (based upon Application NO. 86 10130) relates to a cross-country ski boot sole, torsionally stiff and flexible in the longitudinal direction. This sole includes a reinforcement located at least in the metatarsophalangeal zone and corresponding to a lasting sole constituted by a composite sheet (glass, carbon or aramid fibers embedded in epoxy or polyester resins). This composite sheet has the characteristic of having fibers that are oriented in two or three directions relative to the longitudinal axis of the sole (multidirectional cloth). This is supposed to make it possible to obtain the desired longitudinal, transverse and torsional stiffnesses. This reinforcement does not involve a sandwich structure. Furthermore, this shoe sole remains perfectible with respect to the transverse rigidity, therefore the steering of the ski, the flexibility, durability, lightness, efficiency, uniformity, and sensitivity of the rolling/unrolling movement, as well as protection of the foot during bendings.

French Patent Application No. 2 682 011 (based upon Application No. 91 12376) relates to a cross-country ski boot whose torsional strength and longitudinal flexibility in the metatarsophalangeal zone are improved, and which includes an outer sole covered with a lasting insole, defining therebetween a peripheral assembly zone referred to as the lasting allowance, which makes it possible to affix the upper and the vamp to the lower portion of the boot. The outer sole has torsional strength properties and it is jointly mounted with the lasting insole made of a material that is flexible in bending (rubber) in a zone corresponding to the front portion of the foot. Furthermore, the lasting insole is made of leather or cellulose fibers in its front end zone corresponding to the zone of the finger bones, whereas the rear portion is made of cardboard, for example.

A sandwich structure is not used in the bottom assembly according to FR 2 682 011, and it has proven that the torsional strength, and therefore the control of the ski, remain perfectible.

Furthermore, this boot could also be improved with respect to optimizing its efficiency, which results from the spring power in this zone of the metatarsophalangeal bending axis zone.

Finally, the materials used in the lasting insole of this boot do not have all of the guarantees desired in terms of stability of the mechanical properties over time.

Therefore, it must be noted that the prior technical propositions are not entirely satisfactory, or are unsuited to resolving the technical problem(s) including:

- increasing the torsional stiffness so as to improve the steering and control of the sports apparatus, while optimizing the bending ability in the metatarsophalangeal zone, so as to enable a uniform and flexible rolling/unrolling movement of the boot, and to further make it possible to perceive the reactions of the sports apparatus and of the ground, and therefore to proportion the forces;
- improving the efficiency of the boot by optimizing the spring power in the metatarsophalangeal zone, without negatively affecting the flexibility of the torsional stiffness;
- using materials that meet the aforementioned specific mechanical specifications, and are capable of conserving those properties or qualities, and therefore the subsequent behaviors, over an extended period of time (slow degradation-increased durability);
- further reducing the weight of the boot;
- protecting the foot during bendings by minimizing the compressive stresses to which the foot is subject;
- maintaining the cost within acceptable limits;
- developing a reinforcement that is industrially easy to manufacture.

One of the objects of the present invention is to provide a reinforcement for a boot, in particular a sports boot (e.g., for cross-country skiing), which procures significant improvements with respect to the aforementioned technical specifications.

Another object of the invention is to propose a reinforcement for a cross-country ski boot that makes it possible to improve the ski steering efficiency, durability, flexibility, savings in weight, cost, foot protection, industrial workability.

Another object of the present invention is to provide a boot, especially a sports boot, and more specifically a cross-country ski boot, having a reinforcement in the bottom assembly that is capable of meeting the aforementioned specifications at best.

These objects, among others, are achieved by the present invention which relates primarily to a reinforcement for a boot, in particular a sports boot, of the type adapted to cooperate with a sports apparatus along a movement in which, the tip of the boot being affixed to the sports apparatus, the heel can be displaced between a position supported on the sports apparatus and a position raised relative to the sports apparatus, this reinforcement:

- extending over at least a portion of a front zone A, located on both sides of the metatarsophalangeal joint, from the front end up to the beginning of the plantar arch, over at least a portion of a median zone B corresponding to the plantar arch and over at least a portion of a rear zone C corresponding to the heel and starting from the end of the plantar arch and ending at the rear end;
- being adapted to improve the longitudinal flexibility of the zone A, on the one hand, and the torsional rigidity at least of the zone A, on the other hand, wherein:
  - it includes, at least in the zones B and C at least one "sandwich" structure constituted by at least one core inserted between at least two layers; and
  - in the zone A, it is flexible in a substantially longitudinal direction and torsionally stiff.

According to the invention, the choice of a material having a sandwich structure at least in the rear zone C corresponding to the heel and in the zone B corresponding to the plantar arch contributes to obtaining the desired results in terms of longitudinal flexibility and torsional stiffness in the metatarsophalangeal front zone A. The same is true with respect to the efficiency of the boot (spring power in the zone A), steering of the ski, durability, lightness, ease and precision of the rolling/unrolling movement of the foot and of the boot, as well as protection of the foot during bendings.

The present invention also relates to a boot, in particular a sports boots, and more particularly a cross-country ski boot, including the reinforcement such as defined in the present disclosure.

BRIEF DESCRIPTION OF DRAWINGS

The invention will be better understood from the following description of a non-limiting example of a preferred embodiment of the reinforcement and boot considered.

This description is provided with reference to the annexed drawings, in which.

DETAILED DESCRIPTION OF THE INVENTION

Figure 1:
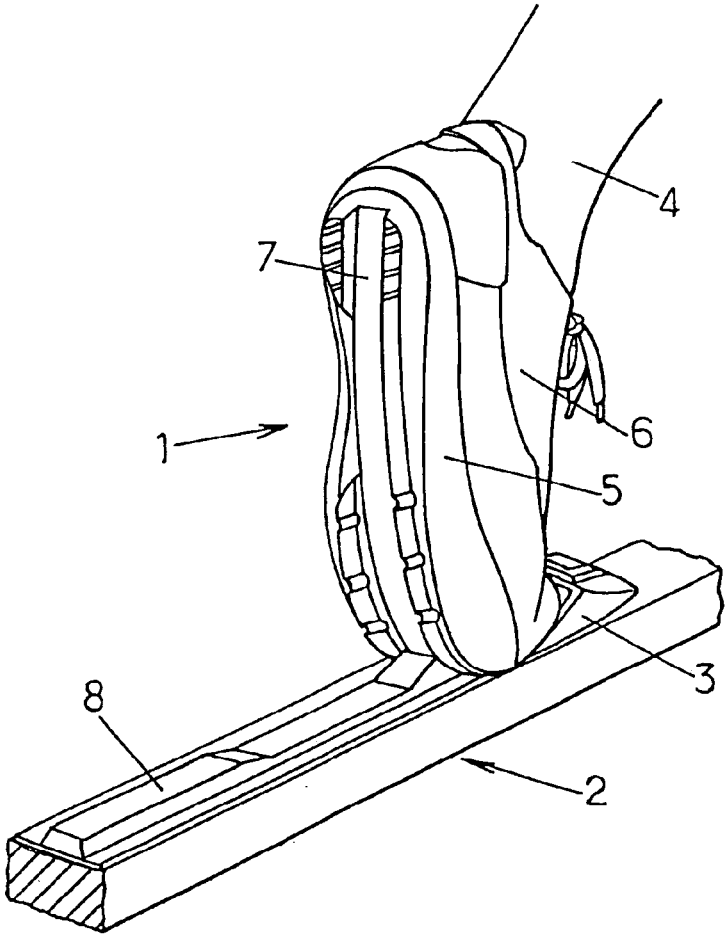
FIG. 1 is a perspective view of a cross-country ski boot, according to the invention, which is reversibly fixed to a cross-country ski by its front tip and raised relative to the cross-country ski along a flexional rolling movement.

The invention relates to a reinforcement for a boot, for example a cross-country ski boot, designated by the reference numeral 1 in the drawings. This cross-country ski boot is removably fixed at its front tip to a cross-country ski 2 equipped with a binding 3. The lower leg, including the foot and ankle positioned in the boot 1, is schematically illustrated in FIG. 1 and are designated by the common reference numeral 4. The boot 1 includes an outer sole 5 and a vamp/upper 6. In FIG. 1, the boot 1 is shown in the raised position of the heel relative to the ski 2.

Figure 2:
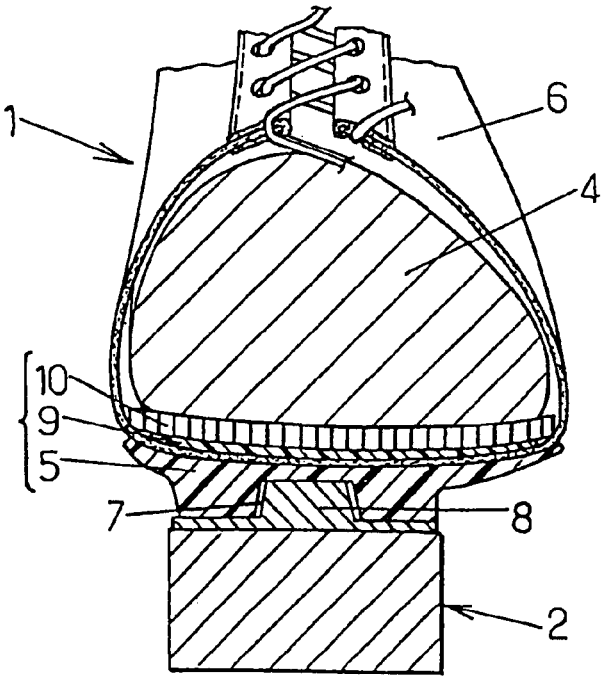
FIG. 2 is a transverse cross-sectional view of the boot and ski shown in FIG. 1.
Figure 4A:
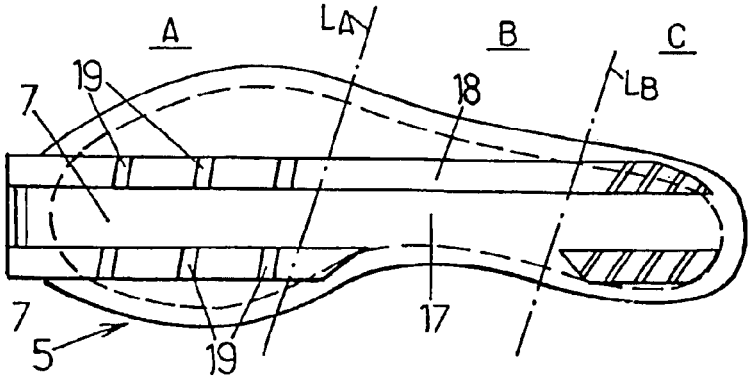
FIGS. 4A and 4B show a bottom view and a side view, respectively, of the outer sole of the boot shown in FIGS. 1 and 2.

FIG. 2 shows the boot 1 in a position supported on the upper surface of the cross-country ski 2. As seen in FIGS. 1, 2 and 4A, the outer sole 5 of the boot 1 has a longitudinal groove 7 adapted to cooperate with a guiding rib 8 affixed to the upper surface of the ski 2. The groove 7 and rib 8 have complementary transverse trapezoidal cross sections. The guiding groove 7 of the outer sole 5 is partially defined by two parallel side bars 18 having, in their front portion, transverse recesses 19 adapted to improve the bending flexibility of the sole without compromising its torsional rigidity (FIG. 4A).

Figure 11:
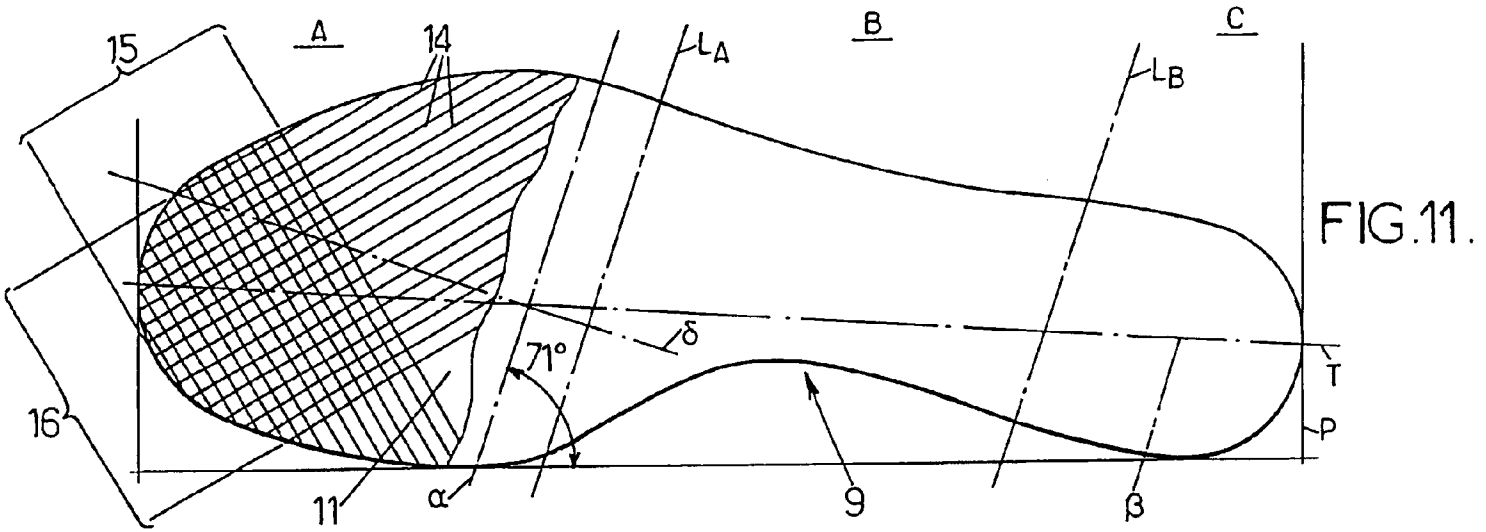
FIG. 11 is a bottom view of a lasting insole similar to that shown in FIG. 5A, with a partial tear in the front zone A, of a first example of manufacture of the fibrous web of the reinforcement according to the invention.

The boot 1 and foot 4 move from the unrolled position supported on the ski of FIG. 2 to the rolled (raised) position of FIG. 1, by bending about the metatarsophalangeal bending axis shown in FIG. 11 and designated by the reference character $\alpha$.

As seen in FIG. 2, the lower portion or bottom assembly of the boot 1 includes the outer sole 5 on which rests the lasting insole 9 overlaid by an inner sole 10, and affixed to the upper portion of the boot constituted by the vamp/upper 6 by means of an assembly by sewing and/or welding and/or cementing of the lower edge of the vamp 6 which, in this case, is inserted between the lasting insole 9 and the outer sole 5.

Figure 4B:
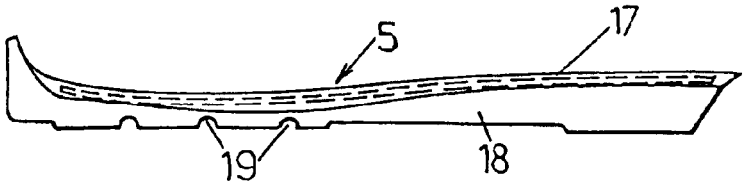
Figure 5A:
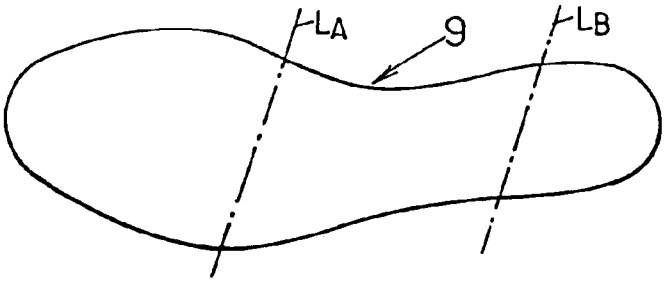
FIGS. 5A and 5B show a bottom view and a side view, respectively, of the lasting insole appearing in FIG. 2.
Figure 5B:
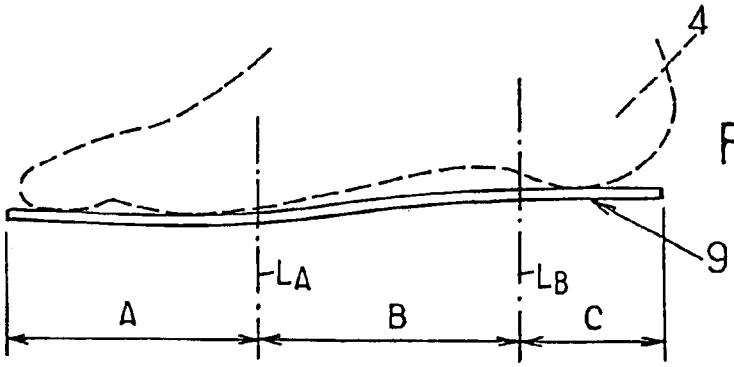
Figure 3:
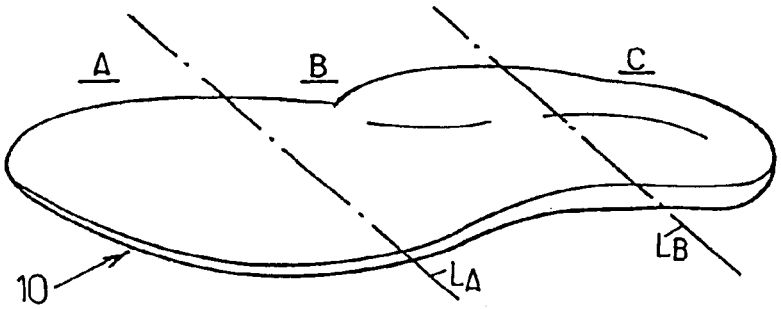
FIG. 3 is a perspective view of the inner sole of the boot shown in FIGS. 1 and 3.

According to the invention, the reinforcement is integrated into, or made unitary with, at least one of the constituent elements 5, 9, 10 of the lower portion of the boot 1, namely:

an inner sole 10, shown in FIGS. 2 and 3;

a lasting insole 9, shown in FIGS. 2, 5A and 5B; and an outer sole 5 shown in FIGS. 2, 4A and 4B.

According to an alternative embodiment, the reinforcement integrally or unitarily constitutes one of the constituent elements 5, 9, 10.

The boot reinforcement considered here is schematically divided into three zones with reference to the anatomy of the foot, namely:

the front zone A extending on both sides of the metatarsophalangeal bending axis $\alpha$ as shown in FIG. 11 and corresponding to the positioning of the metatarsophalangeal joint, which forms an angle of about 71/72° with the inner tangent T to the foot, and which is located along this same tangent at about 73/74% of the total length of the foot from the rear end P;

the median zone B extending from the rear limit $L_A$ of the zone A corresponding to the front of the plantar arch up to the rear of the plantar arch;

the rear zone C extending from the rear limit $L_B$ of the zone B up to the end of the heel.

FIG. 5B schematically shows the foot 4 in dotted lines, and the zones A, B, C are defined with reference to the foot anatomy.

The reinforcement according to the invention can be divided into three zones A, B, C indicated in FIGS. 3, 4A, 4B 5A, 5B.

The same is true with respect to FIGS. 6–10, which schematically show five different embodiments of the reinforcement according to the invention, and which show the sandwich structure specific to the zones B and C, and possibly A.

This sandwich structure includes two layers, namely, an upper layer 11 and a lower layer 13 between which a core 12 is positioned. The type of materials constituting the layers 11 and 13 and the core 12 in the five embodiments of FIGS. 6–9 is described hereinafter.

According to an advantageous characteristic of the invention, the boot reinforcement to which it relates can be characterized by the longitudinal flexural strengths RfA, RfB, RfC of the zones A, B, C.

Thus, according to a preferred arrangement of the invention, each zone A, B, C has a longitudinal flexural strength RfA, RfB, RfC, such that:

$$RfA<RfB\leqq RfC.$$

Figure 6:
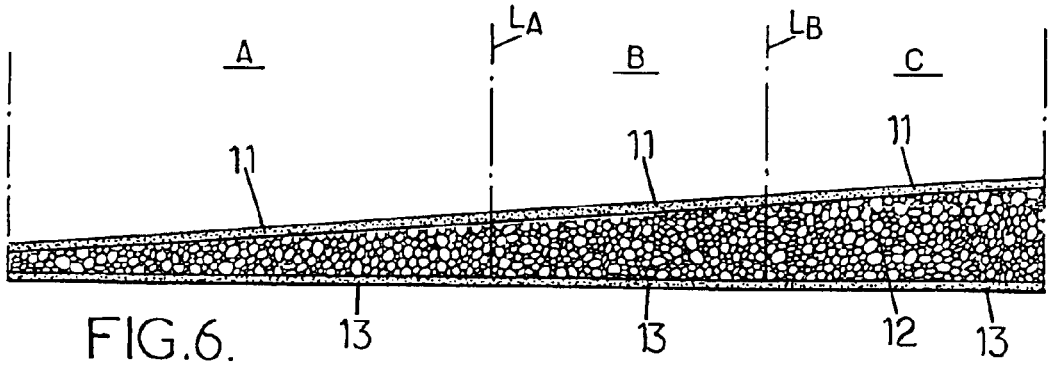
FIG. 6 schematically shows a longitudinal cross-sectional view of a first embodiment of the reinforcement according to the invention.

Yet more preferably:

the zone A has a front-to-rear constant or progressive stiffness RfA;

the zone B has a front-to-rear constant or progressive stiffness RfB;

the zone C has a front-to-rear constant or progressive stiffness RfC;

According to a first embodiment of the reinforcement shown in FIG. 6:

$$RfA<RfB\leqq RfC$$

with front-to-rear progressive RfA, RfB, RfC.

Figure 7:
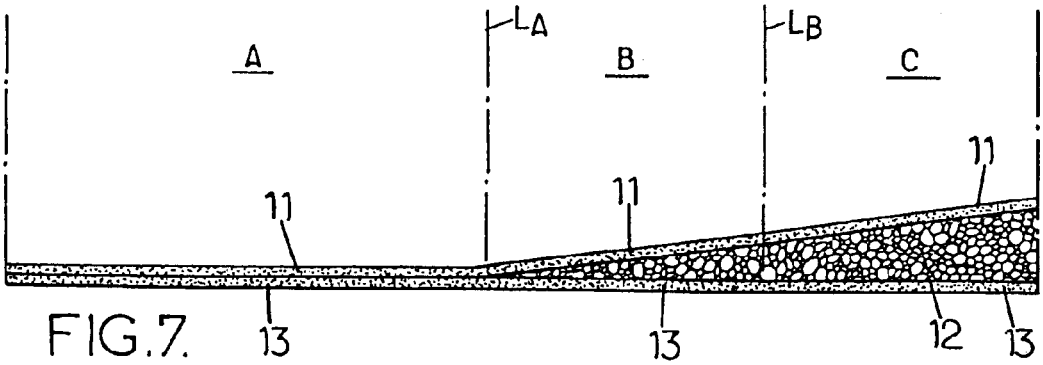
FIG. 7 schematically shows a longitudinal cross-sectional view of a second embodiment of the reinforcement according to the invention.

According to a second embodiment of the reinforcement shown in FIG. 7:

RfA<RfB≦RfC, with:

constant RfA front-to-rear progressive RfB front-to-rear progressive RfC.

In this second embodiment of the reinforcement, two areas of different stiffnesses are provided, namely, the area of minimum stiffness corresponding to the zone A, and an area of progressive stiffness corresponding to the zones B and C.

Figure 8:
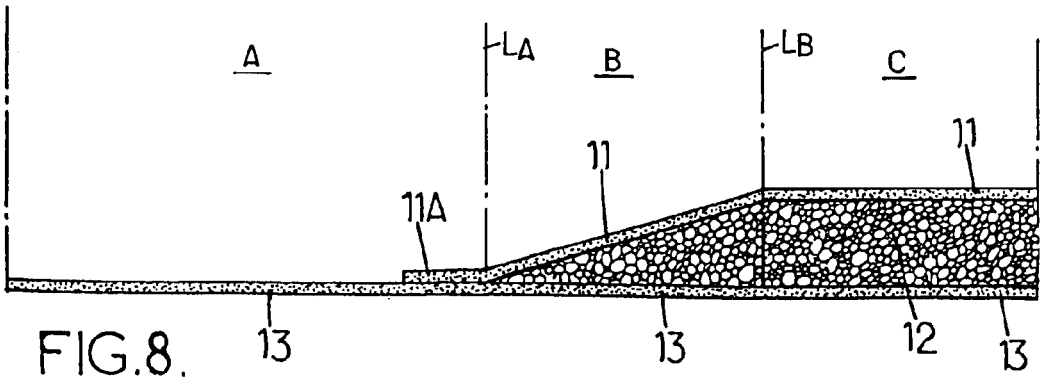
FIG. 8 schematically shows a longitudinal cross-sectional view of a third embodiment of the reinforcement according to the invention.

According to a third embodiment of the reinforcement according to the invention, shown in FIG. 8:

RfA<RfB≦RfC, with:

constant RfA front-to-rear progressive RfB constant RfC.

Figure 9:
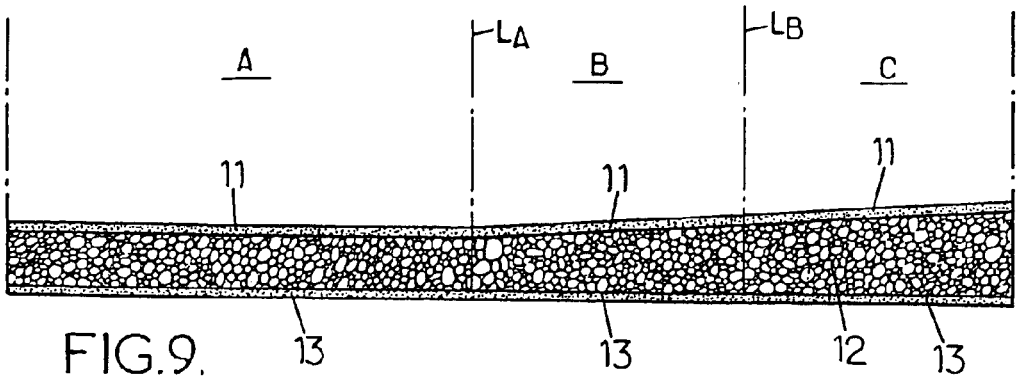
FIG. 9 schematically shows a longitudinal cross-sectional view of a fourth embodiment of the reinforcement according to the invention.

FIG. 9 shows a fourth embodiment in which the sandwich structure extends over the three zones A, B, C, with characteristics of longitudinal flexural strength such as:

constant RfA front-to-rear progressive RfB and RfC.

Figure 10:
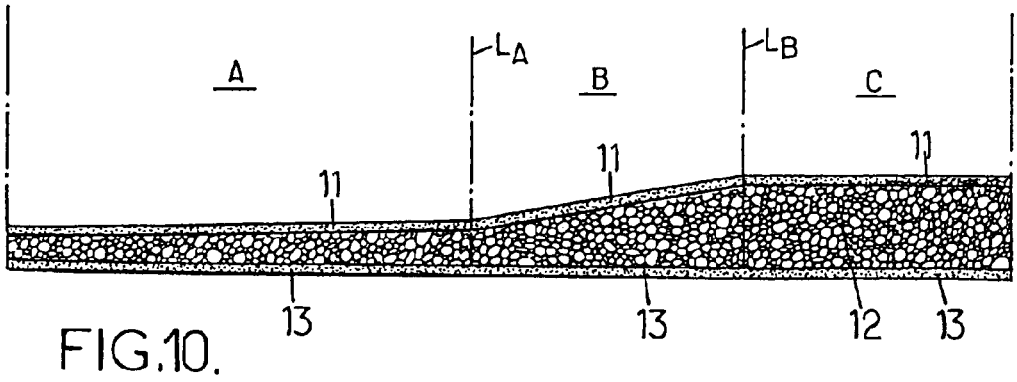
FIG. 10 schematically shows a longitudinal cross-sectional view of a fifth embodiment of the reinforcement according to the invention.

FIG. 10 corresponds to a fifth embodiment in which the sandwich structure extends over the three zones A, B, C, and in which, as for the third embodiment of FIG. 8, the characteristics of longitudinal flexural strength are as follows:

RfA<RfB≦RfC, with:

constant RfA front-to-rear progressive RfB constant RfC.

The control of the longitudinal flexural strength of the zones A, B, C of the reinforcement is obtained by playing with the type of materials constituting the layers 11 and 13 and the core 12 of the sandwich structure. This longitudinal flexural strength can also be varied by playing with the thickness by progressively varying this stiffness of the reinforcement in the zones A, B, C, as shown in FIGS. 6–10.

According to various alternative embodiments of the examples of FIGS. 6–10, the possible variations in thickness of the reinforcement according to the invention are not linear, knowing that it is preferable not to have any sudden break in slope at the connecting lines, between the zones A and B (rear limit $L_A$ of the zone A), on the one hand, and between the zones B and C (rear limit $L_B$ of the zone B).

With respect to the type of materials used to make the reinforcement, and more particularly its sandwich structure, it must be noted that one, preferably both, of the layers 11, 13, of this sandwich structure is(are) made of a composite material based on woven or non-woven fibers included in a matrix.

These fibers are preferably selected from the group including: carbon fibers, glass fibers, metallic fibers, natural or synthetic textile fibers, and their mixtures; the carbon and glass fibers being particularly preferred.

The material constituting the matrix is preferably selected from the group including: epoxy, polyester or phenolic resins; thermoplastics—advantageously polyamides, polyurethanes, polyolefins—and their mixtures.

Examples of fibers that can be used in the manufacture of the composite layers 11, 13 of the reinforcement according to the invention, include fibers listed in the Table below, which also indicates the type of weaving webs (15, 16, 15', 16') used, as well as the mechanical properties of these networks or fibrous webs.

| Fibers | Weaving | Stress at break greater than | Modulus greater than |
|---|---|---|---|
| Glass | UD | 700 MPa | 25000 MPa |
| Glass | Multidirectional | 350 MPa | 12000 MPa |
| Carbon | UD | 1500 MPa | 70000 MPa |
| Carbon | Multidirectional | 700 MPa | 35000 MPa |

In this Table, UD signifies unidirectional.

Advantageously, the core of the sandwich structure is made of synthetic foams (preferably polyurethane, poly (meth)acrylic, polyvinyl chloride), wood or honeycomb.

In the case of a first embodiment shown in FIG. 6, the zone A has a variable stiffness. This corresponds to the first embodiment shown in FIG. 6.

In the first, fourth, and fifth embodiments (FIGS. 6, 9, 10), the sandwich structure extends into all of the zones A, B, C, whereas it only occupies the zones B and C in the second and third embodiments shown in FIGS. 7 and 8.

The preferred embodiment of the reinforcement according to the invention could be the third embodiment described hereinabove, in which the zone A with minimum RfA stiffness has a minimum constant thickness and conjugates the maximum torsional strength with a low flexural strength.

In all of the embodiments defined hereinabove by way of examples, the median zone B is a zone of evolutional stiffness, variable thickness, and makes it possible to connect the two end zones A and C by providing the progressive stiffness to the reinforcement and to the boot.

The rear zone C has a maximum torsional and flexural strength and (preferably) has constant thickness and stacking characteristics.

According to alternative embodiments, each zone A, B, C can include one or several sub-zones having longitudinal flexural strengths that are:

identical to or different from one another; and constant or evolutional for each sub-zone considered.

As seen in FIGS. 7 and 8 corresponding to the second and third embodiments of the reinforcement according to the invention, the zone A with minimum stiffness RfA does not have any sandwich structure and includes at least one of the two layers 11, 13 of the zones B and C in their continuity, and possibly at least another additional layer, not shown in the drawings.

In the second embodiment of FIG. 7, the zone A of the reinforcement is constituted by the extension of the upper layer 11 of the sandwich structure of the zones B and C, attached to the lower layer 13 of this same sandwich structure.

In FIG. 8, third embodiment, the zone A of the reinforcement is simply constituted by the extension of the lower layer 13 of the sandwich structure of the zones B and C. In this embodiment, the upper layer 11 of the sandwich structure of the zones B and C is extended by a portion 11A up to the zone A for a preferably partial covering with the layer 13 in the zone A, in order to ensure the resistance of the reinforcement in the zone contiguous to the limit between A and B.

Figure 12:
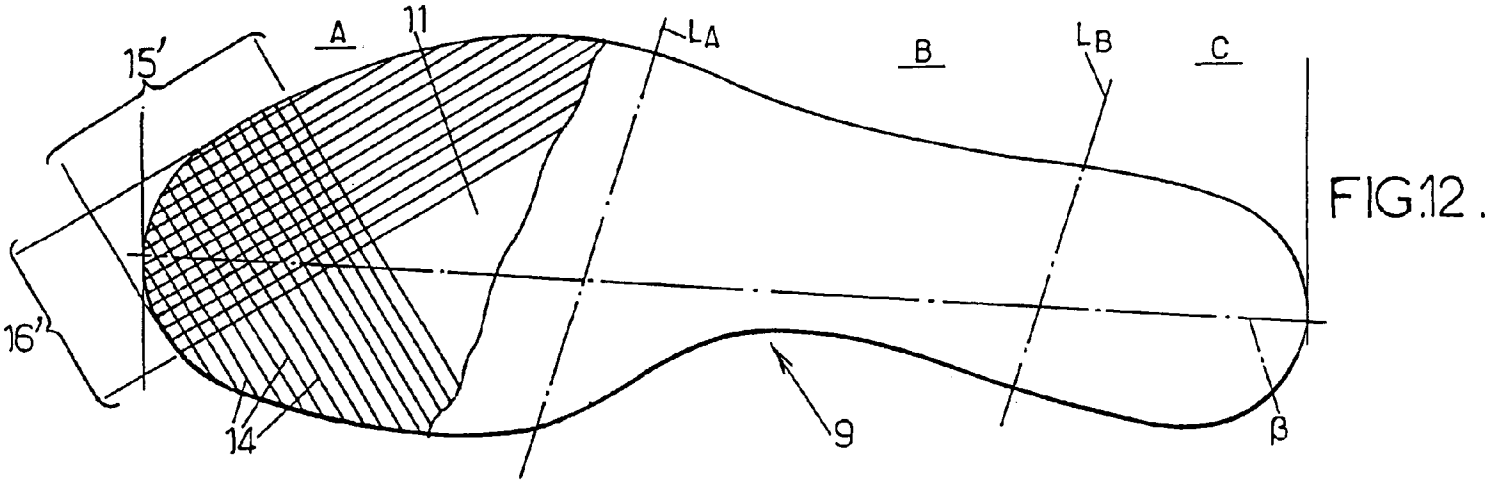
FIG. 12 is a bottom view of a lasting insole similar to that shown in FIG. 5A, with a partial tear in the front zone A, of a second example of manufacture of the fibrous web of the reinforcement according to the invention.

FIGS. 11 and 12 show two methods of manufacturing the reinforcement according to the invention, in particular when it corresponds to the lasting insole 9. These FIGS. 11 and 12 partially show the composite structure of the layers 11 or 13 of the sandwich structure. The fibers 14 of the composite layer(s) 11 or 13 of the sandwich structure are arranged in one or several webs 15 and 16 (FIG. 11), 15', 16' (FIG. 12) of parallel fibers 14, the web(s) 15, 16, 15', 16' being oriented in one or several directions (uni-directional UD or multi-directional orientation).

In the two methods of manufacturing the layers, shown in FIGS. 11 and 12, the reinforcement includes two webs (15 and 16), (15' and 16') of parallel fibers 14, these webs being oriented along different directions.

According to a preferred characteristic of the invention, these two webs (15, 16) and (15', 16') of parallel fibers 14 are symmetrical relative to an axis, the latter preferably being the longitudinal median axis β (FIG. 12) of the reinforcement 9, or the axis δ (FIG. 11) perpendicular to the metatarsophalangeal bending axis α, which forms an angle of about 19°+/−5° relative to the longitudinal median axis β.

Advantageously, the angle between the two webs (15, 16) and (15', 16') of parallel fibers 14 is about 90°+/−10°.

Preferably, each web 15, 16, 15', 16' is constituted by a fiber cloth.

According to an alternative embodiment, the reinforcement of the invention is an insert 17 that is duplicate molded, or fixed in any other manner, in at least one of the constituent elements 5, 9, 10 of the lower portion of the boot, this element being preferably selected from the group including the inner sole 10, lasting insole 9, outer sole 5; the outer sole 5 being more particularly preferred.

FIGS. 4A and 4B show this advantageous alternative embodiment of the invention. The sole 5 includes a duplicate molded insert 17 forming the reinforcement according to the invention.

Advantageously, this insert has a composite structure, of the type described, for example, in the five embodiments of FIGS. 7–10.

According to another alternative embodiment of the outer sole 5 of FIG. 4A, the duplicate molded insert 17 can be made apparent at one or several locations of the lower surface of this outer sole 5. The insert 17 can also extend over part or all of the bottom assembly surface.

According to the invention, it can be envisioned to use special composite sandwich materials for the manufacture of the reinforcement according to the invention. Thus, this reinforcement can be at least partially constituted by one or several micro-sandwich composite sheets each having a thickness less than or equal to 3 millimeters, and including a composite core inserted between at least two composite layers, the mechanical strength and cost per mass unit of the core being less than those of at least one of the layers.

The conventional techniques for producing composites are used to manufacture the reinforcements according to the invention.

Thus, the polymeric foams that can constitute the cores of the sandwich structures are obtained by machining or by injection, for example.

The composite layers of the sandwich structures are obtained by pressure polymerization techniques.

The assembly of the various composite layers and of the core(s), whether made of foam or composite, is carried out by superimposition and pressuring (pressure on the order of 2–10 bars at temperatures of about 100–180° C.).

Gluing and heat sealing techniques can also be used.

According to another one of these aspects, the present invention also relates to a boot, in particular a sports boot, more particularly a cross-country ski boot (FIGS. 1 and 2) characterized in that it includes at least one reinforcement 5, 9, 10, 17 according to the invention, as described hereinabove.

This boot and reinforcement improve the spring power in the metatarsophalangeal journal zone, therefore the efficiency of the boot.

Optimizing the flexibility in bending and torsional stiffness makes it possible to significantly improve the control and steering of the ski.

The materials used are lightweight and maintain their properties over a very long period of time. They impart a behavior on the boot, especially the cross-country ski boot, such that the rolling/unrolling movements are much more uniform and provide the athletes with better sensations.

Finally, the reinforcement according to the invention offers a good foot protection during bending, for it reduces the compressive stresses.

What is claimed is:

1. A reinforcement for a sports boot, adapted to cooperate with a sports apparatus, said reinforcement at least comprising:

a front zone A located on both sides of a line corresponding to an area of a metatarsophalangeal joint of a foot of a wearer, said front zone A extending from a front end of the reinforcement up to a beginning of a plantar arch area of the wearer;

a median zone B corresponding to the plantar arch area of the wearer;

a rear zone C corresponding to a heel of the wearer, said rear zone C starting from an end of the plantar arch area and ending at a rear end of said reinforcement;

at least in the zones B and C, said reinforcement including at least one "sandwich" structure comprising at least one core inserted between at least two layers; and in the zone A, said reinforcement is flexible in a substantially longitudinal direction.

2. A reinforcement according to claim 1, wherein each zone A, B, C has a longitudinal flexural strength RfA, RfB, RfC, respectively, such that:

$$RfA<RfB\leqq RfC.$$

3. A reinforcement according to claim 2, wherein in zone A with minimum stifness RfA, the reinforcement includes at least one of the two layers of the zones B and C in their continuity, and at least one additional layer.

4. A reinforcement to claim 2, wherein in zone A with minimum stiffness RfA, the reinforcement includes at least one of the two layers of the zones B and C in their continuity.

5. A reinforcement according to claim 4, wherein in zone A with minimum stiffness RfA, the reinforcement includes an extension of the lower layer of the sandwich structure of the zones B and C and an extension of the upper layer of the sandwich structure of the zones B and C, which extension covers partially the extension of the layer in said zone A.

6. A reinforcement according to claim 1, wherein;

the zone A has a longitudinal flexural strength RfA in the form of a front-to-rear constant or progressive stiffness;

the zone B has a longitudinal flexural strength RfB in the form of a front-to-rear constant or progressive stiffness;

the zone C has a longitudinal flexural strength RfC in the form of a front-to-rear constant or progressive stiffness.

7. A reinforcement according to claim 6, wherein:

$$RfA<RfB\leqq RfC$$

with RfA, RfB, and RfC having flexural strengths in the form of front-to-rear progressive stiffness.

8. A reinforcement according to claim 6, wherein:

RfA<RfB≦RfC, with:

RfA having a constant stiffness;

RfB having a front-to-rear progressive stiffness;

RfC having a front-to-rear progressive stiffness.

9. A reinforcement according to claim 6, wherein:

RfA<RfB≦RfC, with:

RfA having a constant stiffness;

RfB having a front-to-rear progresssive stiffness;

RfC having a constant stiffness.

10. A reinforcement according to claim 6, wherein:

RfA<RfB≦RfC, with:

RfA having a front-to-rear progressive stiffness;

RfB having a front-to-rear progressive stiffness;

RfC having a constant stiffness.

11. A reinforcement according to claim 1, wherein one of the layers of said sandwich structure is made of a composite material based on woven or nonwoven fibers included in a matrix, wherein:

the fibers comprise a member selected from the group consisting of the following materials: carbon fibers, glass fibers, metallic fibers, natural and synthetic texile fibers, and mixtures of such materials;

the matrix comprises a member selected from the group consisting of the following materials: epoxy, polyester, and phenolic resins; thermoplactics, including polyamides, polyurethanes, polyolefins, and mixtures of such materials;

and the core of the sandwich structure comprises a member selected from the group consisting of the following materials: a synthetic foam, wood and a honeycomb structure.

12. A reinforcement according to claim 11, wherein the fibers of the composite layer(s) of the sandwich structure are arranged in one or several webs of parallel fibers, the web(s) being oriented in one or several directions (unidirectional UD or multidirectional orientation).

13. A reinforcement according to claim 12, further comprising at least two webs of parallel fibers, wherein these two webs are oriented along different directions;

and wherein these two webs of parallel fibers are symmetrical relative to an axis (β,δ), said axis being the longitudinal median axis (β) of the reinforcement, or the axis (δ) perpendicular to the metatarsophalangeal bending axis (α) and forming an angle of about 19°+/−5°relative to the longitudinal median axis, the angle between the two webs of parallel fibers being about 90°+/−10°.

14. A reinforcement according to claim 1, wherein the reinforcement corresponds to at least one constituent element of the lower portion of the boot, said constituent element preferably comprising a member selected from the group consisting of the inner sole, the lasting insole, and the outer sole.

15. A reinforcement according to claim 1, wherein the reinforcement is an insert that is duplicate molded with at least one of the constituent elements of the lower portion of the boot, said one of the constituent elements comprising a member selected from the group consisting of the inner sole, the lasting insole, and the outer sole.

16. A reinforcement according to claim 1, wherein the reinforcement has a variable thickness, generally increasing from the front of the zone A to the rear of the zone C, and wherein said variation in thickness is linear or nonlinear, without any break in slope in the area of the connecting lines, between the zones A and B (rear limit $L_A$ of the zone A), and between the zones B and C (rear limit $L_B$ of the zone B).

17. A reinforcement according to claim 1, wherein the reinforcement is at least partially constituted by one or sevezal micro-sandwich composite sheets each having a thickness less than or equal to 3 mm, and comprising a composite core inserted between at least two composite layers, the mechanical strength and cost per mass unit of the core being less than those of at least one of the layers.

18. A sports boot, wherein said sports boot includes at least one reinforcement according to claim 1.

19. A cross-country ski boot, wherein said cross-country ski boot includes at least one reinforcement according to claim 1.

20. A reinforcement according to claim 1, wherein both of the layers of said sandwich structure are made of a composite material based on woven or nonwoven fibers included in a matrix, wherein:

the fibers comprise a member selected from the group consisting of the following materials: carbon fibers, glass fibers, metallic fibers, natural and synthetic textile fibers, and mixtures of such materials;

the matrix comprises a member selected from the group consisting of the following materials: epoxy, polyester, and phenolic resins; thermoplastics, including polyamides, polyurethanes, polyolefins, and mixtures of such materials;

and wherein the core of the sandwich structure comprises a member selected from the group consisting of the following materials: a synthetic foam, wood, and a honeycomb structure.

21. A reinforcement according to claim 1, wherein at least one of the layers of said sandwich structure is made of a composite material based on woven or nonwoven fibers included in a matrix, wherein:

the fibers comprise carbon fibers and/or glass fibers;

the material constituting the matrix comprises a member selected from the group consisting of the following materials: epoxy resin, polyester resin, phenolic resin, a polyamide, a polyurethane, a polyolefin, and mixtures of such materials;

and wherein the core of the sandwich structure comprises a member selected from the group consisting of the following materials: a polyurethane foam, a poly(meth) acrylic foam, a polyvinyl chloride foam, wood, and a honeycomb structure.

22. A reinforcement according to claim 1, wherein the reinforcement is an insert that is duplicate molded with at least the outer sole.

23. A reinforcement according to claim 1, wherein the reinforcement has a variable thickness along a length of the reinforcement, and wherein said variation in thickness is linear or nonlinear.

24. A reinforcement according to claim 1, wherein, in the zone A, said reinforcement is flexible in a substantially longitudinal direction and torsionally stiff.

* * * * *